US011627785B2

(12) United States Patent
Le Gall

(10) Patent No.: US 11,627,785 B2
(45) Date of Patent: Apr. 18, 2023

(54) DEVICE FOR FINELY ADJUSTING THE LENGTH OF A BRACELET AND A BRACELET COMPRISING AT LEAST ONE SUCH DEVICE

(71) Applicant: PATEK PHILIPPE SA GENEVE, Geneva (CH)

(72) Inventor: Eric Le Gall, Nyon (CH)

(73) Assignee: PATEK PHILIPPE SA GENEVE, Geneva (CH)

( * ) Notice: Subject to any disclaimer, the term of this patent is extended or adjusted under 35 U.S.C. 154(b) by 0 days.

(21) Appl. No.: 17/311,876

(22) PCT Filed: Dec. 10, 2019

(86) PCT No.: PCT/IB2019/060611
§ 371 (c)(1),
(2) Date: Jun. 8, 2021

(87) PCT Pub. No.: WO2020/121191
PCT Pub. Date: Jun. 18, 2020

(65) Prior Publication Data

US 2022/0022611 A1 Jan. 27, 2022

(30) Foreign Application Priority Data

Dec. 10, 2018 (EP) ..... 18211364

(51) Int. Cl.
*A44C 5/24* (2006.01)

(52) U.S. Cl.
CPC ..... *A44C 5/246* (2013.01)

(58) Field of Classification Search
CPC ..... A44C 5/246
See application file for complete search history.

(56) References Cited

U.S. PATENT DOCUMENTS 4,928,359 A * 5/1990 Gagnebin ..... A44C 5/2042 24/DIG. 46
5,175,912 A * 1/1993 Chevalley ..... A44C 5/22 24/71 J (Continued)

FOREIGN PATENT DOCUMENTS

| | | |
|---|---|---|
| CH | 594 380 | 1/1978 |
| CH | 696 697 | 10/2007 |
| CH | 699 067 | 10/2011 |
| CH | 705 058 | 12/2012 |
| CH | 707 483 | 7/2014 |

(Continued)

OTHER PUBLICATIONS

International Search Report for PCT/IB2019/060611, dated Mar. 12, 2020, 5 pages.

(Continued)

*Primary Examiner* — Robert Sandy
*Assistant Examiner* — Rowland Do
(74) *Attorney, Agent, or Firm* — Nixon & Vanderhye

(57) ABSTRACT

A device for finely adjusting the length of a bracelet inserted between two elements of the bracelet and includes an outer part attached to one, an inner part attached to the other and to slide in the outer part parallel to the longitudinal direction of the bracelet, causing the length of the bracelet to be varied, and a stop arranged to limit the travel of the inner part relative to the outer part so the bracelet cannot be extended beyond a maximum length. The outer part includes a wall having an immobilization hole on its inner side. The inner part includes a pivoting lever with a first end biased by a spring toward the outer part wall, permitting the first end to engage the immobilization hole, immobilizing the inner part relative to the outer part. The inner part has a control member permitting manual control of the lever.

18 Claims, 9 Drawing Sheets

(56) References Cited

U.S. PATENT DOCUMENTS

| | | | | |
|---|---|---|---|---|
| 5,623,838 | A * | 4/1997 | Cuche | A44C 5/08 63/5.1 |
| 8,001,658 | B2 * | 8/2011 | Christian | A44C 5/246 24/71 J |
| 9,049,906 | B2 * | 6/2015 | Schmidt | A44C 5/246 |
| 2013/0286797 | A1 * | 10/2013 | Leger | A44C 5/18 24/316 |
| 2014/0130545 | A1 * | 5/2014 | Leger | A44C 5/246 63/3.2 |
| 2017/0265606 | A1 * | 9/2017 | Mace | A44C 5/027 |
| 2018/0153267 | A1 | 6/2018 | Christian et al. | |
| 2019/0254391 | A1 * | 8/2019 | Celant | A44C 5/08 |
| 2019/0380456 | A1 * | 12/2019 | Granito | A44C 5/246 |
| 2020/0405018 | A1 * | 12/2020 | Granito | A44C 5/246 |
| 2021/0022457 | A1 * | 1/2021 | Schaller | A44C 5/02 |

FOREIGN PATENT DOCUMENTS

| | | |
|---|---|---|
| CN | 204796896 U | 11/2015 |
| EP | 1 654 950 | 5/2006 |
| EP | 1 908 366 | 4/2008 |
| EP | 2 319 348 | 5/2011 |
| EP | 2 759 222 | 7/2014 |
| EP | 2 875 747 | 5/2015 |
| EP | 3 162 241 | 5/2017 |
| EP | 3 329 797 A1 | 6/2018 |

OTHER PUBLICATIONS

Written Opinion of the ISA for PCT/IB2019/060611, dated Mar. 12, 2020, 6 pages.

* cited by examiner

DEVICE FOR FINELY ADJUSTING THE LENGTH OF A BRACELET AND A BRACELET COMPRISING AT LEAST ONE SUCH DEVICE

This application is the U.S. national phase of International Application No. PCT/IB2019/060611 filed 10 Dec. 2019, which designated the U.S. and claims priority to EP Patent Application No. 18211364.7 filed 10 Dec. 2018, the entire contents of each of which are hereby incorporated by reference.

BACKGROUND OF THE INVENTION

Field of the Invention

According to a first aspect of the present invention, this invention relates to a device for finely adjusting the length of a bracelet, the device being intended to be inserted between two elements of the bracelet and comprising an outer part arranged to be attached to one of the two elements, an inner part arranged to be attached to the other element of the bracelet and to slide in the outer part parallel to the longitudinal direction of the bracelet so as to cause the length of the bracelet to be varied, and stop means arranged to limit the travel of the inner part relative to the outer part so that the bracelet cannot be extended beyond a maximum length, the outer part further comprising a wall having at least one immobilisation hole on its inner side, and the inner part comprising hooking means and a spring arranged to cause the hooking means to be engaged in said at least one hole so as to permit the inner part to be immobilised with respect to the outer part in at least one relative position, giving the bracelet a specific length. The present invention relates in particular to such a fine adjustment device intended to be inserted between two elements of a watch bracelet and it especially relates to such a fine adjustment device intended to form part of a bracelet provided with a folding type clasp comprising at least one opening and closing cover.

According to a second aspect, the present invention relates to a bracelet comprising at least one device for finely adjusting its length.

DESCRIPTION OF THE RELATED ART

Devices for finely adjusting the length of a bracelet which correspond to the definition given above are already known. CH 699 067 B1 in particular describes a fine adjustment device for a bracelet provided with a folding type clasp comprising at least one opening and closing cover comprising an upper face and two lateral faces which are symmetrical with respect to each other and each have two bores. The opening and closing cover of the clasp simultaneously forms part of the clasp and of the fine adjustment device, and the latter also comprises a base support arranged to be housed in a sliding manner inside the opening and closing cover. The base support comprises fixing means arranged to cooperate selectively with one of the two bores in each of the lateral faces. Since each lateral face comprises two bores, it will be understood that the fine adjustment device makes it possible to choose between two different bracelet lengths. The fixing means comprise a bar which serves to attach a strap of the bracelet to the base support, and the two ends of which are further each provided with a ball catch. The bar is mounted in the base support so that the two balls protrude on either side through openings provided in the sides of the support.

Since the base support is housed in the opening and closing cover so as to slide between the two lateral faces, it will be understood that the balls of the two catches are permanently pushed by their respective spring in the direction of the inner sides of the two lateral faces of the cover. When the position of the base support in the cover is such that the two balls are each located opposite a bore they are partially engaged in these bores so that the base support is immobilised relative to the cover. When the balls are engaged in the pair of bores associated with the shortest length of the bracelet it will suffice to pull on one of the straps of the bracelet in order for the balls to leave the bores in which they are engaged and to roll against the inside of the lateral faces of the cover in order to become engaged in the other pair of bores. One advantage of this known fine adjustment device is that it permits the wearer of the bracelet to increase the length thereof by using just one hand and without removing the bracelet. However, it will be understood that the feature just described is not always advantageous. In fact, the wearer of a bracelet fitted with this known fine adjustment device runs the risk of inadvertently initiating lengthening of the bracelet as a result of an impact or even simply by flexing his/her wrist.

EP 2 875 747 A1 proposes a way of overcoming this problem. It describes a device for finely adjusting the length of a bracelet which is in accordance with the definition given in the preamble. The outer part of this device comprises a rack arranged inside its upper face, and the inner part comprises hooking means in the form of a catch, as well as a spring arranged to bias the catch against the rack. The teeth arrangement of the rack is asymmetrical. When the wearer of the bracelet exerts a force on the bracelet strap fixedly attached to the inner part in such a way as to push this inner part more deeply into the outer part, one of the teeth of the rack repels the catch by causing it to pivot against the spring so that the catch becomes disengaged from the rack. The inner part is thus free to slide in a direction corresponding to a shortening of the bracelet. Conversely, if the wearer of the bracelet exerts a force on the bracelet strap in the direction corresponding to the lengthening of the bracelet, this force produces no effect. In fact, the catch then ensures locking between the inner part and the outer part by cooperating with the other side of one of the asymmetric teeth of the rack. It will be understood that the feature just described is not always advantageous. In fact, if the wearer of a bracelet fitted with this fine adjustment device is not precise enough in handling it, he/she may shorten the bracelet too much and then have to open the clasp in order to loosen it.

SUMMARY OF THE INVENTION

One aim of the present invention is to overcome the disadvantages of the prior art which have just been explained. The present invention achieves this aim as well as others by providing a device for finely adjusting the length of a bracelet.

In the present description, the expression "longitudinal axis" (of the device for finely adjusting the length of a bracelet) designates an axis of said device which coincides with the longitudinal axis of the bracelet when the device is inserted between two elements thereof. Similarly, certain parts of said device may be qualified as "upper" and "lower" with reference respectively to the outer and inner sides of the bracelet.

According to the invention, the inner part comprises a slide and a lever arranged in a pivoting manner in a housing of the slide, the lever forming part of the hooking means and having a first end which is arranged to be biased by the spring in the direction of the wall of the outer part so as to permit the lever to cooperate with said at least one immobilisation hole in order to fixedly attach the inner part relative to the outer part in at least one position, giving the bracelet a specific length less than the maximum length, and in that the inner part comprises a control member arranged to permit manual control of the lever in order to move the first end away from the immobilisation hole in which it is inserted, so as to detach the inner part from the outer part.

It will thus be understood in particular that in accordance with the invention the outer part comprises at least one immobilisation hole but that it is not fitted with a rack. Furthermore, the inner part and the outer part are fixedly attached to each other as long as the lever is cooperating with the immobilisation hole. In order to detach the inner part from the outer part it is necessary to manually actuate the control member so as to move the folded end of the lever away from the immobilisation hole. A first advantage of the invention is thus that an accidental impact or vigorous flexing of the wrist does not risk causing inadvertent lengthening of the bracelet. A second advantage is that the wearer of the watch cannot change the length of the bracelet once it is closed. There is thus no risk of having to re-open it because it is too tight.

In accordance with one particular embodiment of the invention, the wall of the outer part comprises an upper face in which said at least one immobilisation hole is formed. Furthermore, the lever is arranged to pivot in a plane which is normal to the upper face and which contains the longitudinal axis of the bracelet.

In accordance with another particular embodiment of the invention, the inner part comprises an auxiliary stop arranged to cooperate with an edge of the outer part so as to limit the travel of the inner part relative to the outer part so that the length of the bracelet cannot be less than the minimum length, and according to an advantageous variant of this latter embodiment, the minimum length is equal to the specific length. It will thus be understood that in accordance with this advantageous variant, the auxiliary stop acts in concert with the lever and the immobilisation hole in order to immobilise the inner part with respect to the outer part in a relative position, giving the bracelet a minimum length. One advantage of this embodiment is that it provides the possibility of optimising the match between the immobilisation hole and the lever so that the inner part is positioned without longitudinal play relative to the outer part.

In accordance with another advantageous variant of the embodiment mentioned above, the slide has two bores arranged on either side and opposite each other, and the auxiliary stop comprises at least one fixing arm provided with a through-hole which is arranged coaxially between the two bores. Finally, the auxiliary stop is fixed to the slide with the aid of a pin which is orientated perpendicularly to the length of the bracelet and which is inserted through the through-hole and the two bores. It will be understood that the auxiliary stop must be able to be separated from the rest of the inner part so as to permit the fine adjustment device to be dismantled. An advantage associated with the above-mentioned variant is that the assembly and disassembly of the auxiliary stop and of the slide are particularly easy. Finally, the pin preferably also fulfils the function of a pivot axis for the lever. One advantage of this latter variant is that it further simplifies the task of assembling or disassembling the fine adjustment device. It will be further understood that, according to this variant, the lever is arranged to pivot about an axis perpendicular to the longitudinal axis of the bracelet.

BRIEF DESCRIPTION OF THE DRAWINGS

Other features and advantages of the present invention will become clear upon reading the following description, given solely by way of non-limiting example, and made with reference to the attached drawings in which:

FIGS. 5A and 5B show the first end of the lever respectively engaged in, and moved away from, the immobilisation hole;

FIG. 5C showing the first end of the lever engaged in the auxiliary hole;

FIGS. 8A and 8B respectively showing the fine adjustment device in a short configuration and a long configuration of the bracelet;

DESCRIPTION OF THE PREFERRED EMBODIMENTS

Figure 1A:
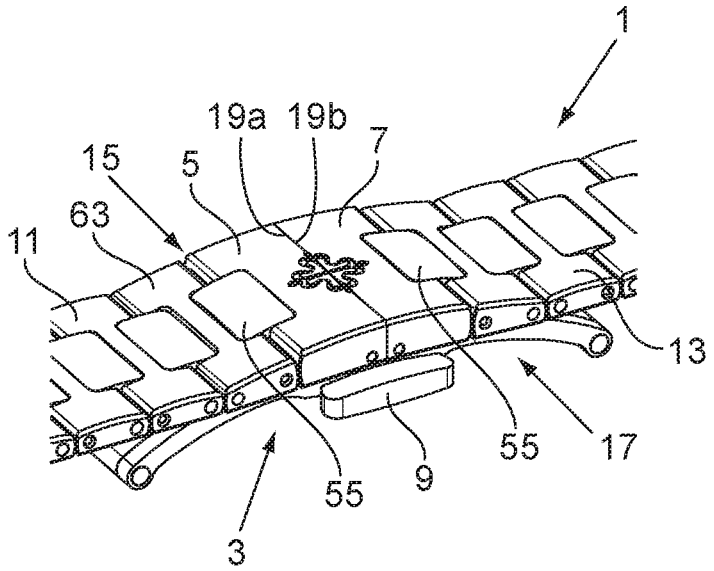
FIGS. 1A and 1B are perspective views of the outer side of a bracelet fitted with a deployant butterfly buckle clasp and a pair of fine adjustment devices according to a first embodiment of the invention, FIGS. 1A and 1B respectively showing the fine adjustment devices in a short configuration and a long configuration of the bracelet.

FIGS. 1A, 1B, 2A and 2B are perspective views of a bracelet 1 fitted with a deployant butterfly buckle clasp 3. The clasp 3 is show in the closed position in FIGS. 1A and 1B and in the open position in FIGS. 2A and 2B. It comprises, in a conventional manner, two symmetrical pivoting strips articulated to a base strip, two opening and closing half-covers (referenced 5 and 7 respectively) mounted in a pivoting manner on the ends of the two pivoting strips, and a safety lock which can be actuated using two push buttons (referenced 9). In a totally conventional manner, the two half-covers 5, 7 are arranged to be positioned face to face, one against the other when the bracelet is closed. "Closing edge" 19*a* (or 19*b*) will refer hereinunder to the edge, of one or other of the half-covers, which faces the closing edge of the other half-cover in FIGS. 1A and 1B. Folding type clasps are well known to a person skilled in the art. This is the reason why the clasp 3 of the present example will not be described in more detail. An example of a safety folding clasp is described in EP 3 162 241 A1. This document is incorporated by reference into the present description.

Figure 1B:
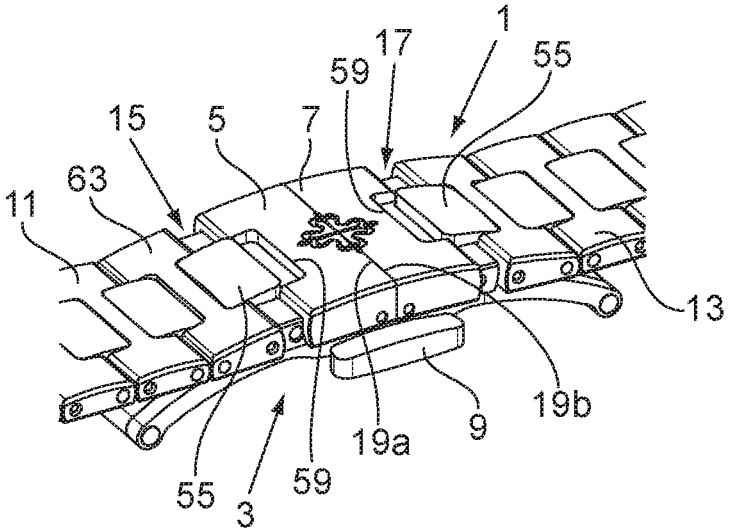
Figure 2A:
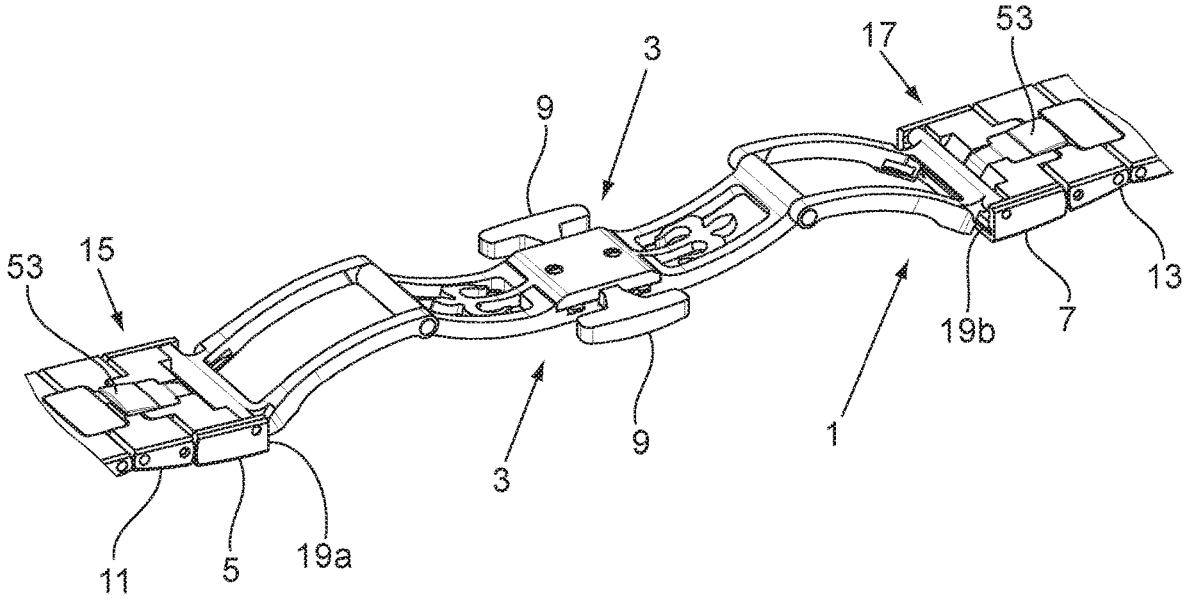
FIGS. 2A and 2B are perspective views of the inner side of the bracelet of FIGS. 1A and 1B, and which show the buckle of the clasp of the bracelet in the unfolded configuration, FIGS. 2A and 2B respectively showing the fine adjustment devices in a short configuration and a long configuration of the bracelet.
Figure 2B:
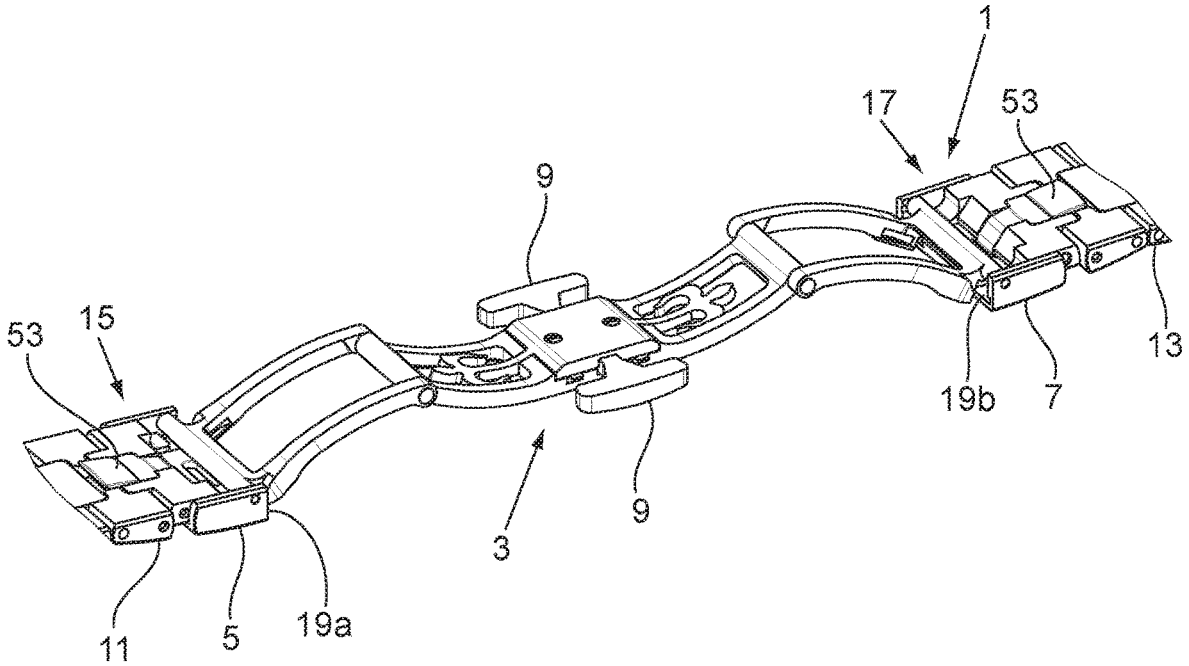

In the illustrated example, the two half-covers 5 and 7 are also attached respectively to two straps 11, 13 of the bracelet via a first and a second fine adjustment device (referenced respectively 15 and 17) which are both in accordance with a first embodiment of the invention. The two fine adjustment devices can be identical and, in accordance with what will be described in more detail hereinunder, their presence makes it possible to adjust the length of the bracelet 1 between a (short) basic length and a (longer) comfort length. FIGS. 1A and 2A show the bracelet with the two fine adjustment devices 15, 17 in the configuration associated with the basic length of the bracelet, whereas FIGS. 1B and 2B show it with the two devices in the configuration associated with its comfort length. As can be recognised from considering the figures, the dimensions of the fine adjustment devices 15 and 17 are substantially the same as those of the links of the bracelet 1. This uniformity in the dimensions makes it possible to produce bracelets formed of homogeneous elements, and thus also homogeneous bracelets.

FIGS. 3A to 8B are views which show in more detail one of the two fine adjustment devices 15 and 17 of the bracelet 1 of FIGS. 1A, 1B, 2A and 2B. In accordance with the invention, the fine adjustment device comprises an outer part and an inner part which is arranged to slide in the outer part, parallel to the longitudinal direction of the bracelet. In accordance with the embodiment to which the present example relates, the two opening and closing half-covers 5, 7 of the clasp 3 each fulfil the function of an outer part for the fine adjustment device (15 and 17 respectively) with which they are associated. In accordance with the invention, the inner part of the illustrated fine adjustment device comprises a slide 20 comprising a housing 21, and further comprises a lever 23 (shown in FIGS. 5A, 5B and 5C) and a spring 25 (shown in FIGS. 6 and 7) which are arranged in the housing 21, the lever having a first end 27 which, as will be seen in more detail hereinunder, is arranged to permit the inner part to be immobilised with respect to the outer part.

Elements 23, 27; 123, 127 define hooking arranged to cooperate with the at least one immobilisation hole 37; 137*a*, 137*b* so as to immobilise the inner part with respect to the outer part in at least one relative position.

Figure 3A:
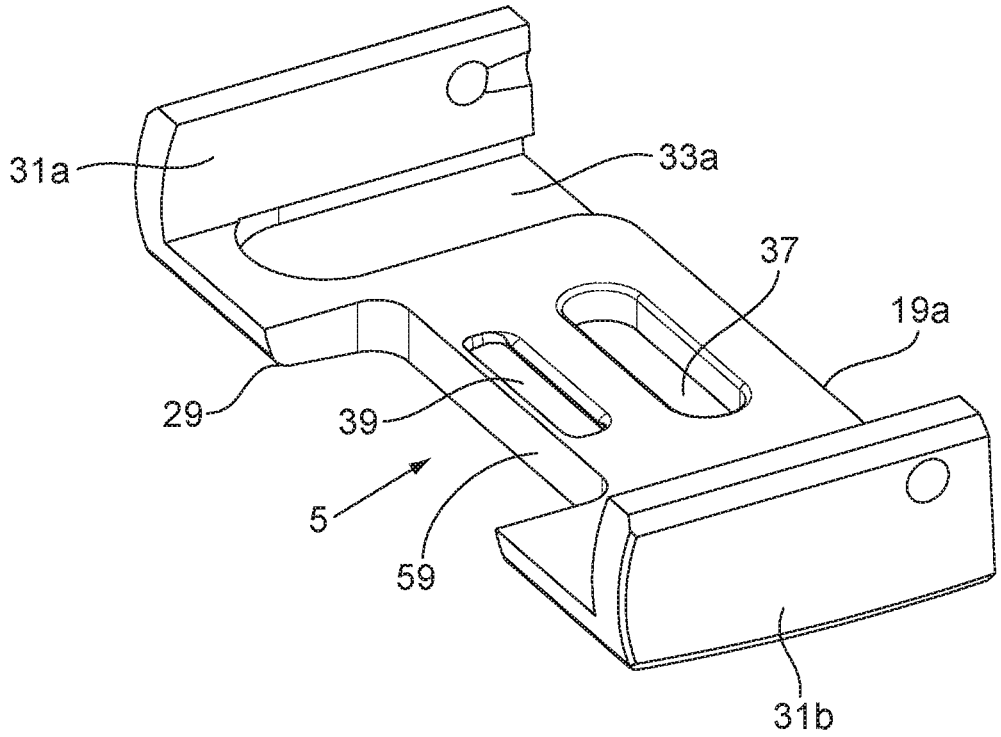
FIGS. 3A and 3B are perspective views from below respectively showing the cover and the slide of one of the fine adjustment devices of FIGS. 1A, 1B, 2A and 2B.

FIG. 3A is a perspective view from below of the outer part 5. With reference in particular to this figure it is possible to see that the outer part generally has an inverted "U"-shaped profile, its cross-section being substantially uniform. The base of the inverted U is formed by the upper face 29 of the half-cover and the two uprights are formed by two opposing lateral faces 31*a* and 31*b*. It is possible to see that the inner side of the upper face 29 of the half-cover 5 has an over-thickness in which a number of hollow structures have been formed. Among these it is possible to see firstly an aperture 33*a* having a shape which is elongate in the longitudinal direction of the bracelet. One of the elongate ends of the aperture 33*a* is a closed end forming a base, whereas the opposite end is open and issues to the outside through the closing edge 19*a*. It is also possible to see that the aperture 33*a* adjoins the inner side of the lateral face 31*a* of the half-cover and that it extends even a short distance below the lateral face so as to form a lateral guiding groove at the base of this face. In accordance with the present example, the half-cover 5 is symmetrical. It will thus be understood that the inner side of the upper face 29 also has a second aperture 33*b* (visible in particular in FIGS. 4A and 4B) of elongate shape which adjoins the lateral face 31*b* and so it cannot be seen in FIG. 3A. FIG. 3A also shows a first blind hole 37 referred to hereinunder as "immobilisation hole 37" and a second blind hole 39, which is smaller, referred to hereinunder as "auxiliary hole 39", which are formed in the inner side of the upper face 29, the holes 37 and 39 having a shape which is elongate transversely to the longitudinal direction of the bracelet. Furthermore, it can be seen that the upper face of the cover 5 also has a rectangular indentation 59 which is provided in the edge opposite to the closing edge 19*a*.

Figure 3B:
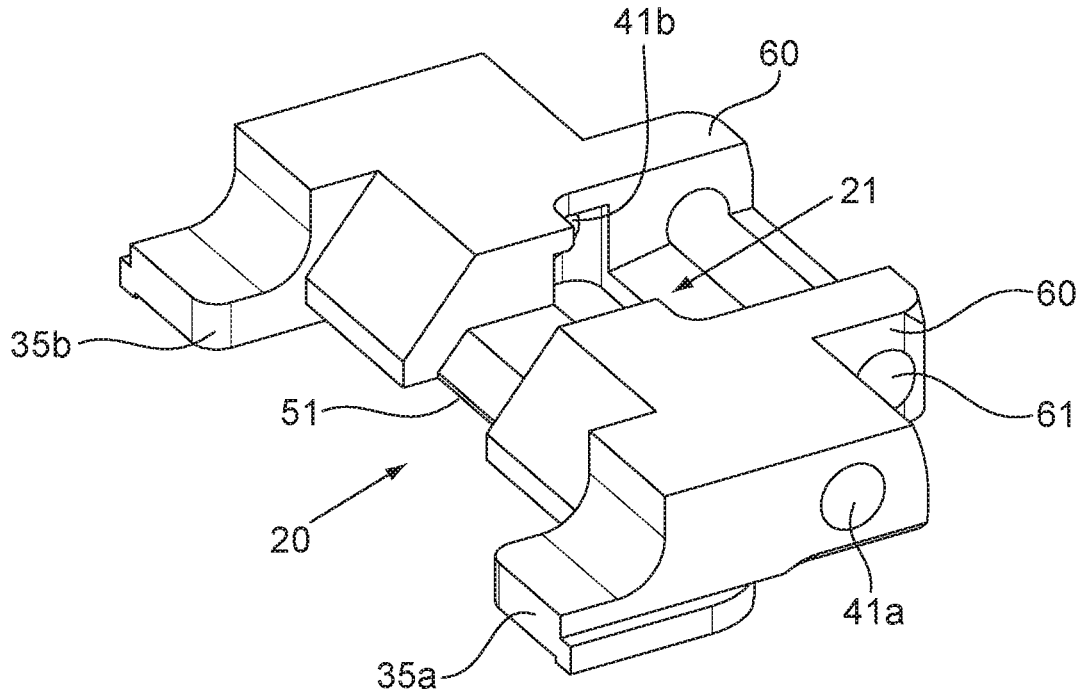

FIG. 3B is a perspective view from below of the slide 20 of the inner part of the fine adjustment device. It is possible to see that the slide comprises a main part dimensioned so as to be able to be inserted between the two lateral faces 31*a*, 31*b* of the outer part, and a narrower connecting part (referenced 60). It is also possible to see that the slide 20 is symmetrical with respect to a plane of symmetry which is parallel to the longitudinal axis of the bracelet, and that a housing 21, which is arranged in the centre of the slide, opens from the lower side of this slide. Still referring to the same figure, it is possible to see that the edge of the main part of the slide 20 also comprises a central notch 51 which is arranged as an extension of the housing 21. It will be understood that the plane of symmetry of the slide 20 passes through the middle of the notch 51. As will be seen in more detail hereinunder, the notch 51 constitutes an opening intended to permit passage of the first end 27 of the lever 23. Moreover, it can be seen that the main part of the slide comprises two bores 41*a*, 41*b* arranged coaxially on either side of the housing 21, and that the connecting part 60 has a transverse bore 61 which extends parallel to the axis common to the bores 41*a* and 41*b*. Finally, the slide 20 also has two lateral runners 35*a* and 35*b* arranged respectively to slide inside the apertures 33*a* and 33*b* of the outer part. It will be understood in particular that during assembly of the fine adjustment device, in order to cause the inner part to enter the outer part 5, the lateral runners 35*a*, 35*b* are introduced by their rounded end into the open ends of the apertures 33*a*, 33*b*. Once the lateral runners 35*a*, 35*b* are inserted into the apertures, the slide 20 is held laterally and vertically inside the outer part by the apertures. However, the slide is free to slide parallel to the longitudinal direction of the bracelet. Referring simultaneously to FIGS. 3A and 3B it is further possible to observe that the shape of the rounded ends of the runners 35*a* and 35*b* is complementary to the shape of the base of the apertures 33*a*, 33*b* so that the base of each aperture constitutes a stop provided to stop the slide 20. It is thus important to note that, in accordance with the embodiment to which the present example relates, the stops provided to stop the slide 20 are not attached pieces but, in contrast, are formed integrally with the half-cover 5. Similarly, the runners 35*a*, 35*b* are not attached pieces. They are actually integrally formed with the slide 20. It will be understood that these features contribute to an increase in the robustness of the device and thus render it more secure.

Elements 33*a*, 35*a*, 33*b*, 35*b*; 135*b* define stop means arranged to limit the travel of the inner part relative to the outer part 5 so that the bracelet cannot be extended beyond a maximum length.

Figure 4A:
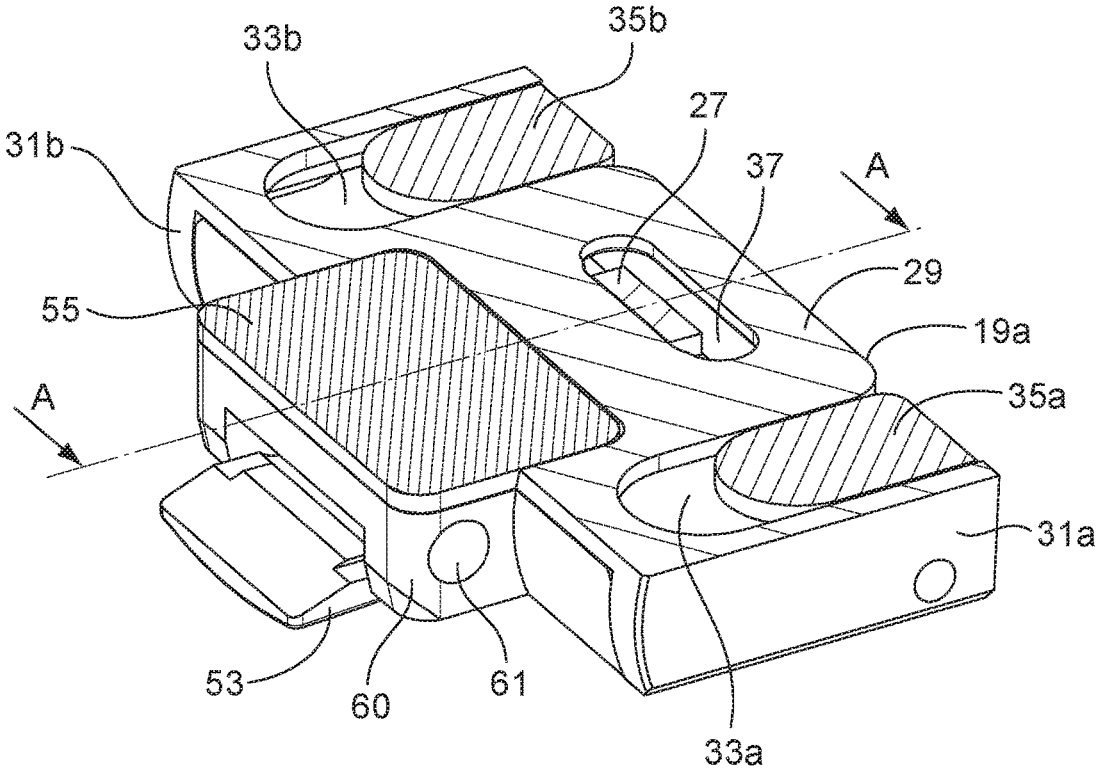
FIGS. 4A and 4B are cut-away perspective views of one of the fine adjustment devices of FIGS. 1A, 1B, 2A and 2B, the outer layer of the upper face of the cover having been omitted, and FIGS. 4A and 4B respectively showing the fine adjustment device in a short configuration and a long configuration of the bracelet.
Figure 4B:
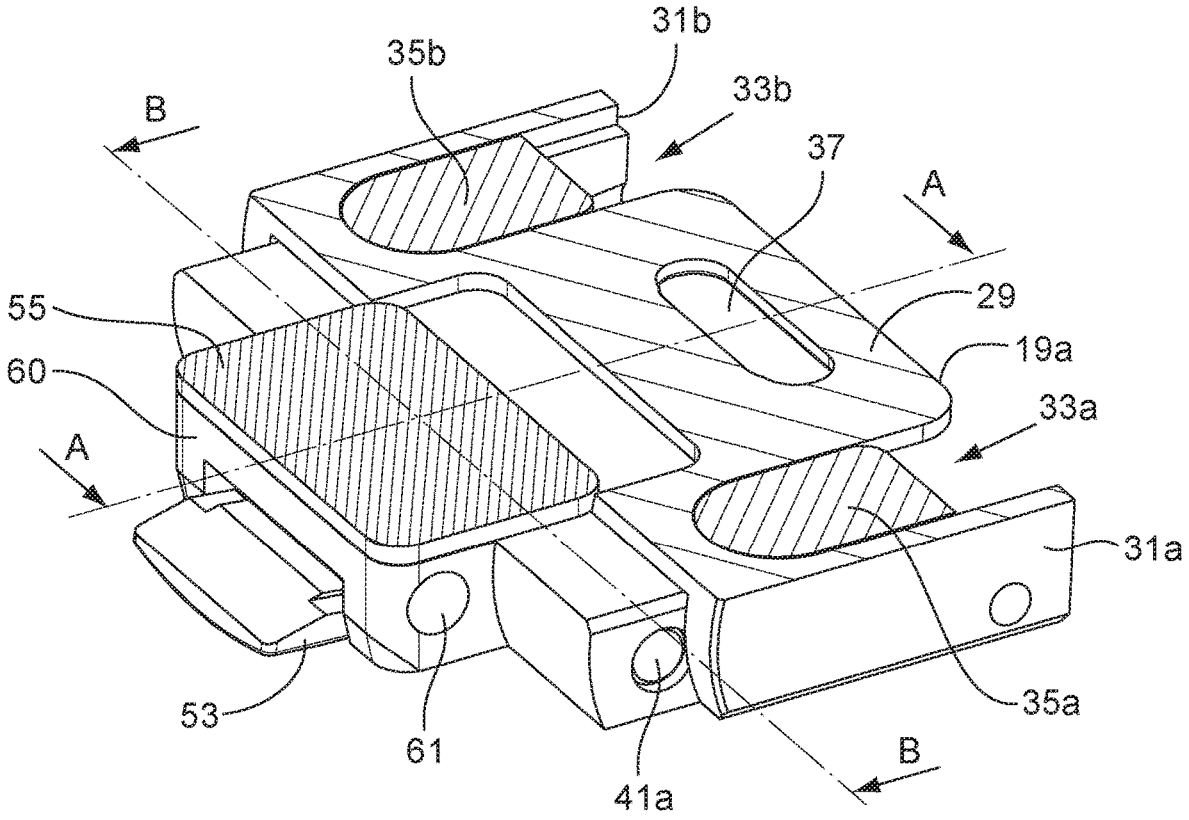

FIGS. 4A and 4B are perspective views of the fine adjustment device of the present example. The figures show the device in two configurations respectively associated with the basic and comfort lengths of the bracelet. It will be noted that the views of FIGS. 4A and 4B are cut-away views. In fact, with the aim of facilitating understanding of the operation of the device, the outer side of the upper face 29 of the cover has not been shown. This omission makes it possible to show the hollow structures formed in the inner side of the upper face.

Figure 5A:
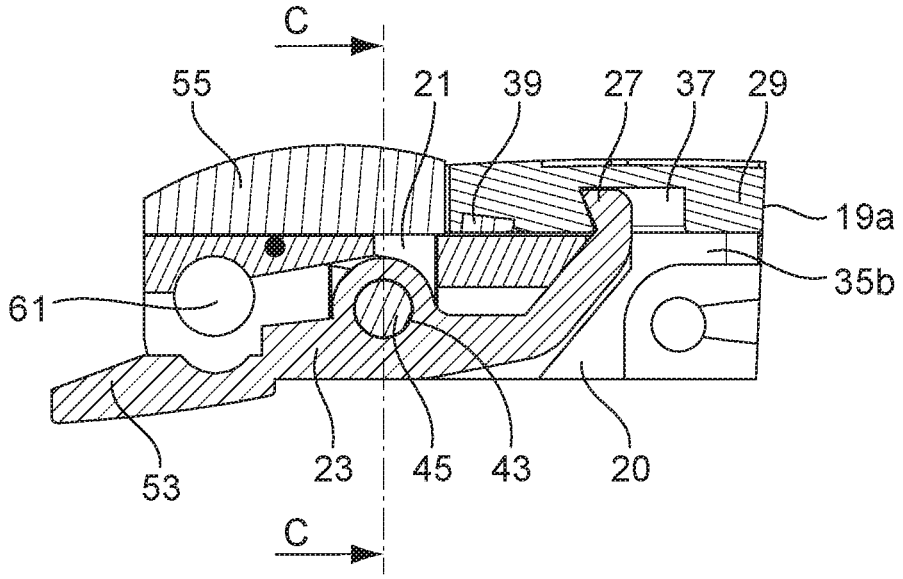
FIGS. 5A and 5B are two cross-sectional views of one of the two fine adjustment devices of the bracelet of FIGS. 1A, 1B, 2A et 2B, the cross-section being taken at the plane in which the lever pivots.
Figure 5B:
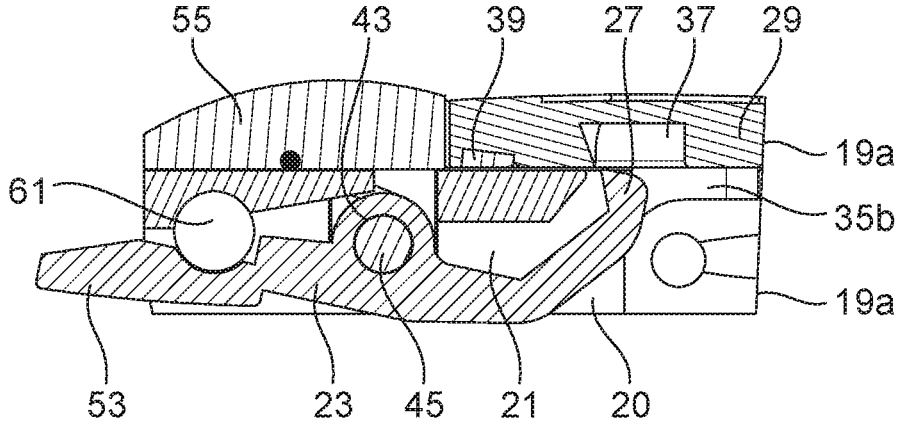
Figure 5C:
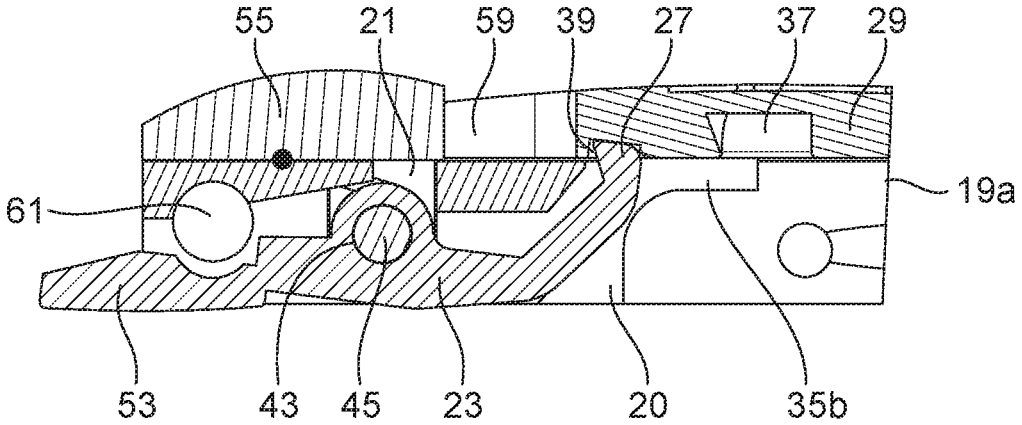
FIG. 5C is a cross-sectional view similar to those of FIGS. 5A and 5B.

FIGS. 5A, 5B and 5C are three cross-sectional views of one of the two fine adjustment devices of the bracelet of FIGS. 1A, 1B, 2A and 2B, the cross-section being taken at the plane A-A of FIGS. 4A and 4B. It is possible to see that, in accordance with the embodiment to which the present example relates, the first end 27 of the lever 23 is curved and it is arranged to cooperate selectively with the immobilisation hole 37 or the auxiliary hole 39 so as to make it possible to immobilise the inner part of the fine adjustment device, with respect to its outer part, in either of two relative positions respectively associated with the basic length of the bracelet and with its comfort length. In relation to this, it is possible to see that FIGS. 5A and 5B show the curved end 27 of the lever 23 respectively engaged in, and spaced apart from, the immobilisation hole 37. As for FIG. 5C, it shows the first end of the lever engaged in the auxiliary hole 39. In accordance with the invention, the inner part further comprises a control member arranged to permit manual control of the lever 23 to move the first end 27 away from the immobilisation hole so as to detach the inner part from the outer part of the fine adjustment device. In accordance with the embodiment to which the present example relates, the lever 23 comprises two mutually opposing ends. The first of these ends is the curved end 27, and the second of these ends is a planar end 53. This latter end is arranged to act as a manually actuatable control member so that a user can make the lever 23 pivot by pressing on the planar end 53 so as to tension the spring 25 (FIG. 7) and to release the curved end 27 from the immobilisation hole 37 or the auxiliary hole 39. It will be understood that when the fine adjustment device is placed in the configuration illustrated in FIG. 5B with the lever 23 released, the spring 25 suddenly throws the end 27 of the lever 23 into the immobilisation hole 37 so that an audible "click" is heard which can warn the user that the lever has returned to the initial position as illustrated in FIG. 5A.

According to one advantageous variant (not illustrated), the wall of the auxiliary hole 39 is inclined so as to permit the end 27 of the lever 23 to be retained within the auxiliary hole 39 when a possible force acting on the bracelet strap which is fixedly attached to the inner part would be liable to push this inner part more deeply into the outer part so that the bracelet would thereby be shortened. The shape of the auxiliary hole according to this variant makes it possible to avoid any risk of inadvertent shortening.

Figure 6:
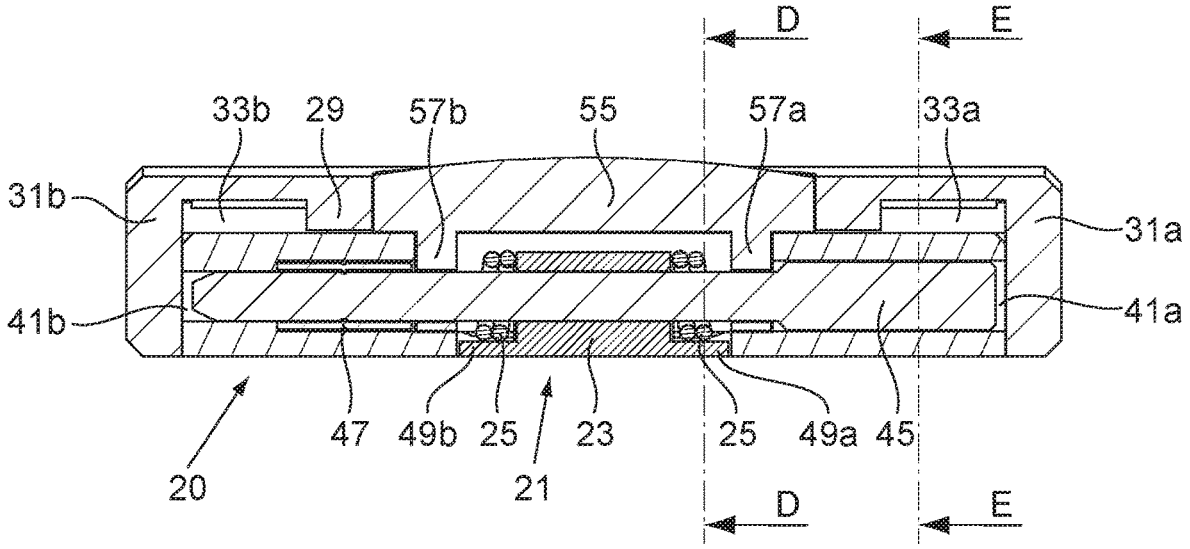
FIG. 6 is a cross-sectional view at the plane C-C of FIG. 5A.

FIG. 6 is a cross-sectional view at the plane B-B of FIG. 4B. Referring simultaneously to FIG. 6 and any one of FIGS. 5A, 5B and 5C it is possible to see that the axis about which the lever 23 is arranged to pivot is formed by the assembly of a notched pin 45 and reducer tube 47. The reducer tube is driven into the bore 41*b* of the slide 20, and the notched pin 45 is arranged to pass through the slide from one side to the other. It thus extends transversely through the bore 41*a*, the housing 21 and the reducer tube 47 which is driven into the bore 41*b*. The head of the notched pin 45 is housed in the bore 41*a*, and on the other side the opposite end of the pin is held inside the reducer tube 47. Furthermore, as the figures show, inside the housing 21, the pin 45 passes in succession through a first of two helicoidal portions of the spring 25, then a bore 43 through the lever 23, and then the other helicoidal portion of the spring 25. In accordance with the embodiment to which the present example relates, the curved end 27 of the lever 23 is arranged to cooperate selectively with the immobilisation hole 37 or the auxiliary hole 39 so as to make it possible to immobilise the inner part with respect to the outer part in either of two relative positions respectively associated with the basic length of the bracelet and with its comfort length.

Figure 7:
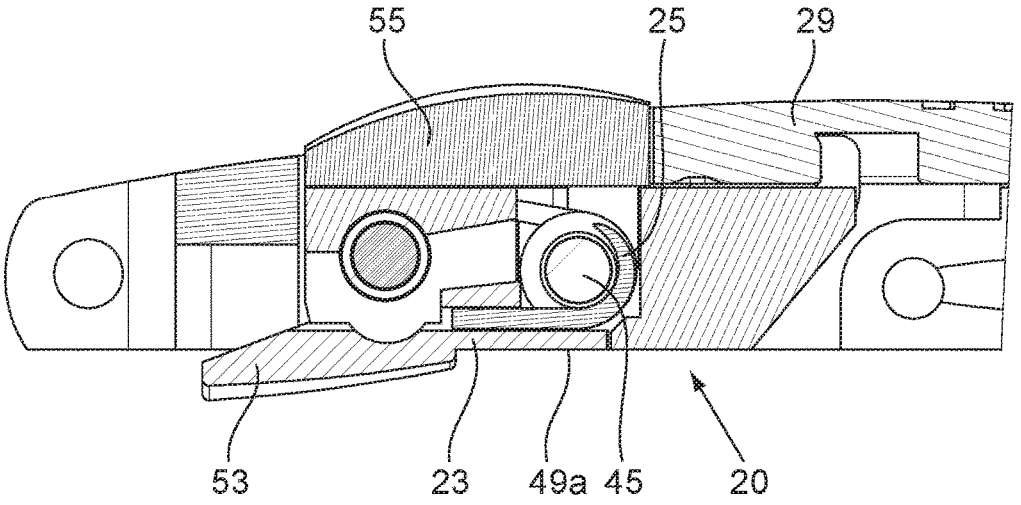
FIG. 7 is a cross-sectional view at the plane A-A of FIG. 6.

FIG. 7 is a cross-sectional view at the plane D-D of FIG. 6. FIGS. 6 and 7 show in particular the spring 25 of the fine adjustment device. As already mentioned, the lever 23 and the spring 25 are arranged in the housing of the slide 20. Referring more particularly to FIG. 6, it is possible to see that the lever 23 is mounted on an axis formed by the notched pin 45 and that it also has two lateral supports 49*a*, 49*b* which are arranged in parallel on either side of the lever itself. It is also possible to understand that the spring 25 comprises two helicoidal portions spaced apart from each other by a distance which corresponds substantially to the width of the central part of the lever 23, and which also have the notched pin 45 passing through them. The two helicoidal portions of the spring 25 are connected to each other by a bent intermediate portion (not visible) which forms a "U" shape. Furthermore, the spring 25 also comprises two straight terminal portions which extend in parallel with each other and transversely to the axis of the helicoidal portions. With reference still to FIGS. 6 and 7, it is possible to understand that the spring 25 is mounted so as to overlap the lever 23, its two terminal portions being respectively wedged on the two lateral supports 49*a*, 49*b*. It will further be understood that when the spring 25 is mounted on the lever 23, its "U"-shaped intermediate portion is arranged to come into abutment against the inner side of a wall portion constituting the upper face of the slide 20. It will be understood that the reaction force exerted by the wall portion on the U-shaped part of the spring 25 is transmitted to the lever 23 by way of the terminal parts of the spring so that the curved end 27 of the lever is biased in the direction of the upper face 29 of the outer part 5 through the opening formed by the housing 51.

Figure 8A:
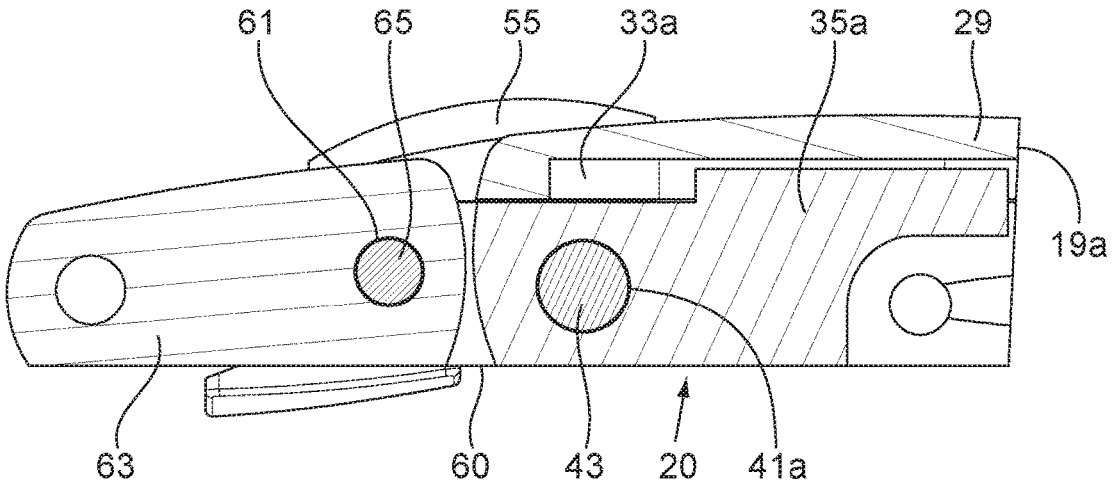
FIGS. 8A and 8B are two cross-sectional views at the plane B-B of FIG. 6.
Figure 8B:
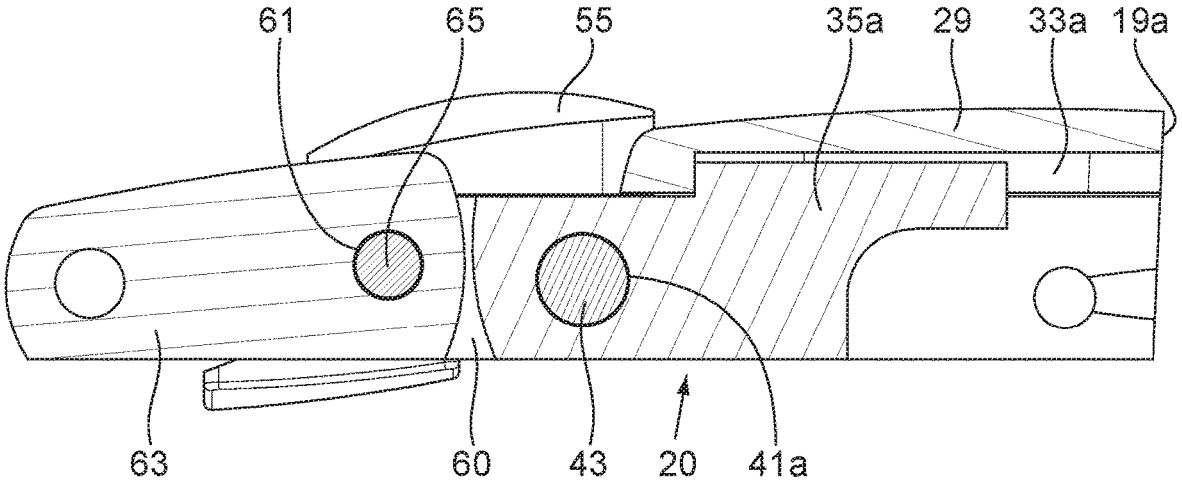

FIGS. 8A and 8B are two cross-sectional views at the plane E-E of FIG. 6, and which show the fine adjustment device in two configurations respectively associated with the basic length and the comfort length of the bracelet. Firstly, it may be observed that FIGS. 8A and 8B also show the end link 63 of the bracelet strap 11 (FIGS. 1A, 1B, 2A and 2B), and it is also possible to see that the slide 20 of the fine adjustment device and the end link 63 are articulated one on the other. In accordance with the illustrated embodiment, the slide 20 comprises a main part arranged to be inserted between the two lateral faces 31*a*, 31*b* of the outer part (FIG. 6), and a narrower connecting part (referenced 60). The articulation between the end link 63 and the slide 20 is achieved in a conventional manner using a pin 65 and a tube (not shown) which are inserted into a transverse bore 61 in the connecting part 60 of the slide. The narrower connecting part 60, the transverse bore 61, and the pin 65 define fixing means arranged to attach the end link 63 of the strap 11 to the inner part of the fine adjustment device.

Referring again to FIGS. 4A, 4B, 5A, 5B, 5C and 6, it is possible to see that the inner part also comprises an auxiliary stop. The auxiliary stop is essentially formed of a rectangular plate 55, the thickness of which is close to that of the upper face 29 of the outer part, and of two fixing arms 57*a*, 57*b* (FIG. 6) arranged perpendicularly to the plate and each having a through-hole. As FIGS. 4A and 4B show, the rectangular plate 55 is placed on the upper face of the slide 20 and the two fixing arms 57*a*, 57*b* pass into the housing 21 via an opening in the upper face of the slide 20. It is possible to see in FIG. 6 that the ends of the fixing arms each come to be housed in a space between one of the helicoidal portions of the spring 25 and one of the two lateral walls of the housing 21. It is further possible to see that the pin 45 passes through the two through-holes so that the auxiliary stop 55 is held in place on the slide by virtue of the pin and the two fixing arms 57*a*, 57*b*. With reference in particular to FIGS. 4A and 4B or to FIG. 1B it is possible to see that the width of the indentation 59 in the upper face 29 of the outer part is suitable to permit reception of the rectangular plate 55 forming the auxiliary stop. Under these conditions, it will be understood that when the inner part is made to slide in the outer part in the direction of the closing edge 19*a*, the rectangular plate 55 is inserted more and more deeply into the indentation 59 and finally abuts against the base thereof so that the inner part is not able to fully exit the outer part. It will thus be understood that, in accordance with the embodiment to which the present example relates, in order to disassemble the inner part from the outer part it is necessary first to remove the pin 45 so as to release the two fixing arms 57*a*, 57*b* of the auxiliary stop. Once the fixing arms are released it is possible to separate the rectangular plate 55 from the slide 20 so as finally to permit the inner part to be removed from the outer part.

As already mentioned, the outer part of the fine adjustment device is articulated on one of the pivoting strips of the clasp, whereas the inner part of the device, for its part, is attached by its connecting part 60 to a strap of the bracelet. It can thus be understood, with reference in particular to FIGS. 8A and 8B, that the length of the bracelet 1 decreases when the inner part is made to slide in the outer part in the direction of the closing edge 19*a*, and that, conversely, the length of the bracelet increases when the inner part of the fine adjustment device is made to slide in the other direction. Furthermore, the travel of the inner part inside the outer part is limited in both directions. As shown in FIG. 8B, the position occupied by the inner part relative to the outer part when the rounded ends of the two runners 35*a* and 35*b* abut against the base of the apertures 33*a*, 33*b* corresponds to the configuration of the fine adjustment device for which the length of the bracelet 1 is at the maximum. Conversely, the position occupied by the inner part relative to the outer part when the edge of the rectangular plate 55 abuts against the base of the indentation 59 (FIG. 1A) corresponds to the configuration of the fine adjustment device for which the length of the bracelet is at the minimum. With reference now also to FIG. 5A, it is possible to see that, in accordance with the embodiment to which the present example relates, the rectangular plate 55 is in abutment against the base of the indentation 59 when the curved end 27 of the lever 23 is engaged in the immobilisation hole 37. Furthermore, it will be understood, with reference simultaneously to FIGS. 4B and 5C, that the two runners 35*a* and 35*b* are in abutment against the base of the apertures 33*a*, 33*b* when the curved end 27 of the lever 23 is engaged in the auxiliary hole 39. It is thus possible to understand that, in accordance with the first exemplified embodiment of the invention, the basic length of the bracelet corresponds to its minimum length, and that the comfort length corresponds to the maximum length of the bracelet. In accordance with the present example, the adjustment device thus has only two stable configurations respectively associated with two different bracelet lengths.

Figure 9A:
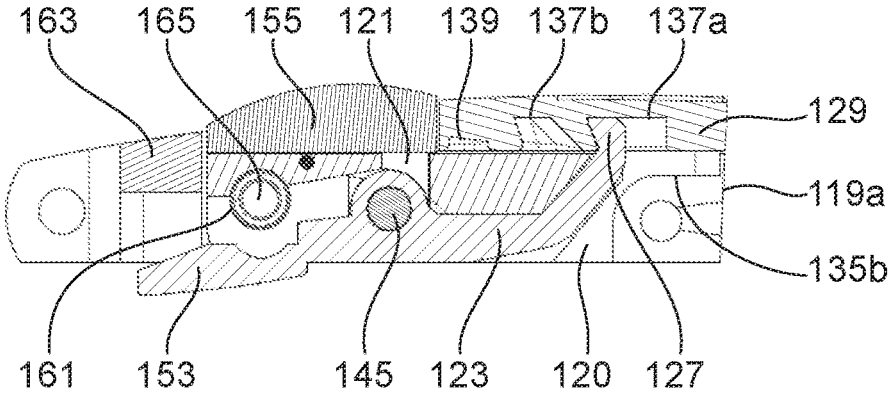
FIGS. 9A, 9B and 9C are three cross-sectional views of a fine adjustment device according to a second embodiment of the invention, the cross-section being taken at the plane in which the lever pivots, and FIGS. 9A, 9B and 9C respectively showing the fine adjustment device in a short configuration, a middle configuration and a long configuration of the bracelet.
Figure 9B:
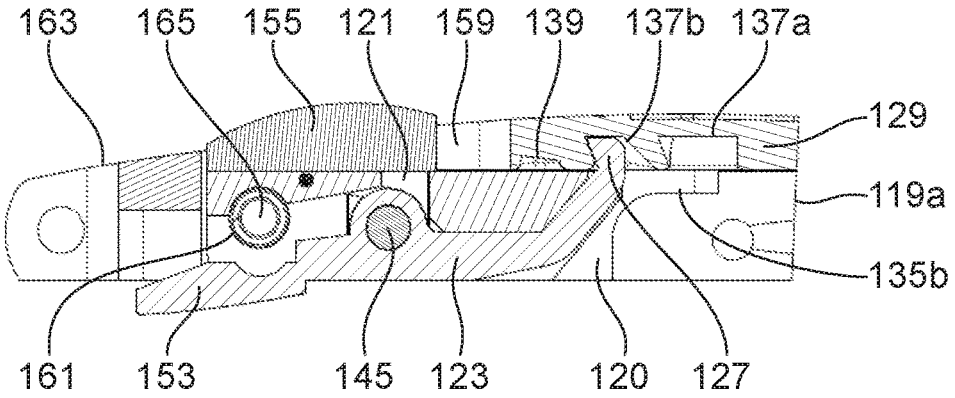
Figure 9C:
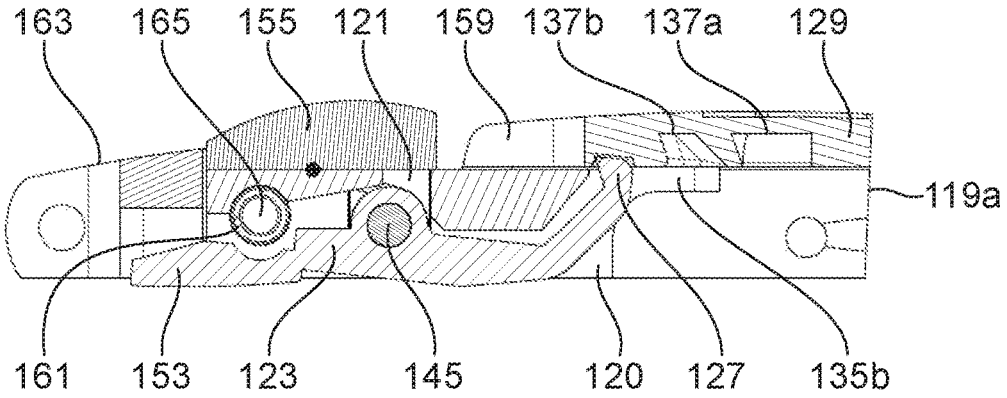

FIGS. 9A, 9B and 9C are three cross-sectional views of a fine adjustment device in accordance with a second embodiment of the invention. This second embodiment comprises many features in common with the first embodiment described above in relation to FIGS. 1A to 8B. The elements of the fine adjustment device of FIGS. 9A, 9B and 9C which are identical or analogous to elements of the first embodiment are designated by the same reference number increased by 100.

It is possible to consider that, among the limited number of features which distinguish the fine adjustment device of the present example from that described in relation to FIGS. 1A to 8B, the most significant is that, in accordance with the present example, the inner side of the upper face 129 of the outer part of the device has three blind holes (instead of two). It is thus possible to understand that, as will be seen in more detail hereinunder, the fine adjustment device of the present example has three stable configurations respectively associated with three different bracelet lengths. Still referring to FIGS. 9A, 9B and 9C, it is possible to see two first blind holes which are of substantially the same depth and will be referred to hereinunder as "first immobilisation hole 137*a*" and "second immobilisation hole 137*b*". Furthermore, it is possible to see a third blind hole which is less deep and which will be referred to hereinunder as "auxiliary hole 139".

In accordance with the second embodiment, the first end 127 of the lever 123 is arranged to cooperate selectively with one of the two immobilisation holes 137*a* and 137*b* or with the auxiliary hole 139 so as to permit the inner part of the fine adjustment device to be immobilised with respect to its outer part in any one of three relative positions respectively associated with a short length, a middle length and a long length of the bracelet. With reference now more particularly to FIG. 9A, it is possible to see that, in accordance with the embodiment to which the present example relates, the rectangular plate 155 is in abutment against the base of the indentation 159 when the curved end 127 of the lever 123 is engaged in the first immobilisation hole 137*a*. Furthermore, it will be understood that when the curved end 127 of the lever 123 is engaged in the auxiliary hole 139 (FIG. 9C), it is the two runners 135*a*, 135*b* which are in abutment against the base of the apertures 133*a*, 133*b*. Thus, in accordance with the second embodiment, the configuration of the fine adjustment device in which the lever 123 cooperates with the auxiliary hole 139 is associated with the maximum length of the bracelet, and the configuration in which the lever cooperates with the first immobilisation hole 137*a* is associated with the minimum length of the bracelet. Finally, the configuration of the fine adjustment device in which the lever cooperates with the second immobilisation hole 137*b* is associated with an intermediate length of the bracelet.

Figure 10A:
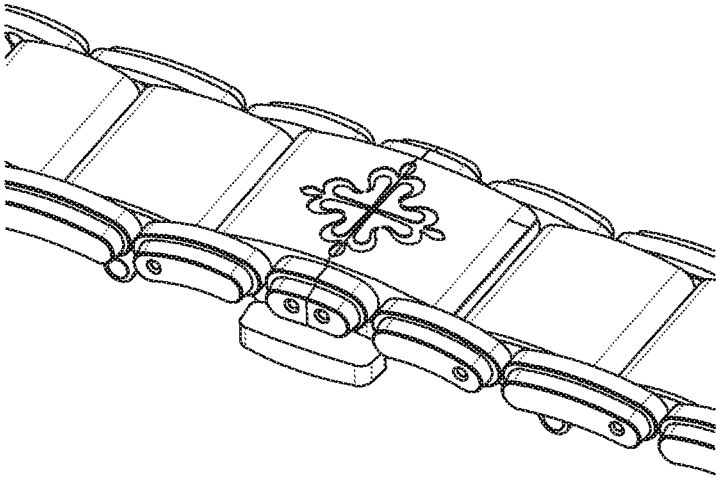
FIGS. 10A and 10B are perspective views similar to those of FIGS. 1A and 1B of the outer side of a bracelet, the bracelet being of a different model, and the two fine adjustment devices being according to a variant of the first embodiment of the invention.
Figure 10B:
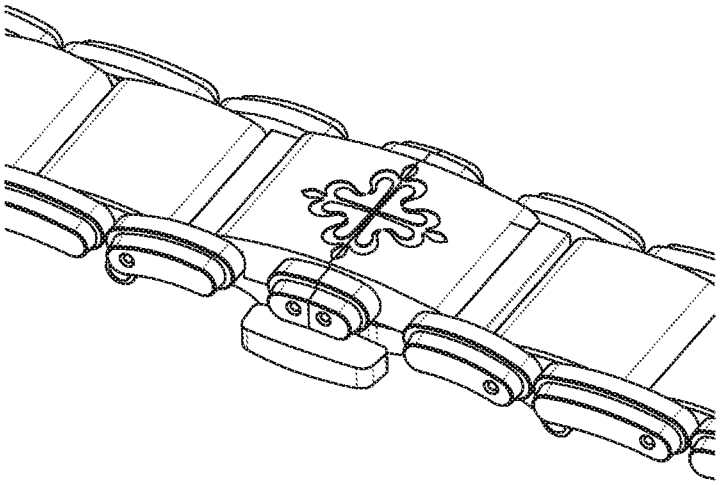

FIGS. 10A and 10B are perspective views similar to those of FIGS. 1A and 1B on the outer side of a bracelet, the bracelet not being of the same model as that in FIGS. 1A and 1B, whereas the two fine adjustment devices are also in accordance with the first embodiment of the invention. FIGS. 10A and 10B illustrate how the fine adjustment device of the invention can be adapted to another model of bracelet while necessitating a minimum number of modifications.

It will also be understood that various modifications and/or improvements obvious to a person skilled in the art can be made to the embodiment being described herein without departing from the scope of the present invention defined by the accompanying claims.

The invention claimed is:

1. A device for finely adjusting the length of a bracelet, intended to be inserted between two elements of the bracelet and comprising:

an outer part arranged to be attached to one of the two elements, an inner part arranged to be attached to the other element and to slide in the outer part parallel to the longitudinal direction of the bracelet so as to cause the length of the bracelet to be varied, and stop means arranged to limit the travel of the inner part relative to the outer part so that the bracelet cannot be extended beyond a maximum length, wherein the outer part further comprises a wall having at least one immobilization hole on its inner side, the inner part comprising hooking means arranged to cooperate with said at least one immobilization hole so as to immobilize the inner part with respect to the outer part in at least one relative position, wherein the hooking means comprise a first end arranged to cooperate with said at least one immobilization hole to fixedly attach the inner part and the outer part together, and wherein the inner part comprises a control member which can be actuated manually to detach the inner part from the outer part, wherein the inner part comprises a removable auxiliary stop arranged to cooperate with an edge of the outer part so as to limit the travel of the inner part relative to the outer part so that the bracelet cannot be shortened to less than a minimum length, wherein the inner part has two bores arranged on either side and opposite each other, and wherein the auxiliary stop comprises at least one fixing arm provided with a through-hole arranged coaxially between the two bores, the auxiliary stop being fixed to the inner part by means of a pin orientated perpendicularly to the length of the bracelet and inserted through the through-hole and the two bores.

2. The fine adjustment device as claimed in claim 1, wherein the control member is arranged to be actuated by pressure from a finger.

3. The fine adjustment device as claimed in claim 1, wherein the wall of the outer part comprises an upper face in which said at least one immobilization hole is formed, and wherein the hooking means comprise a lever arranged to pivot in a plane which is normal to the upper face and which contains the longitudinal axis of the bracelet and a spring arranged to bias a first end of the lever in the direction of the wall of the outer part so as to cause the lever to cooperate with said at least one immobilization hole, said first end of the lever forming the first end of the hooking means.

4. The fine adjustment device as claimed in claim 3, wherein the control member is formed by a second end of the lever opposite to the first end.

5. The fine adjustment device as claimed in claim 4, further comprising a lower side, wherein the lever is arranged in a housing of the inner part so as to protrude from the lower side when the first end of the lever is engaged in said at least one immobilization hole.

6. The fine adjustment device as claimed in claim 3, wherein the first end of the lever is curved so as to have a negative relief angle.

7. The fine adjustment device as claimed in claim 1, the bracelet being provided with a folding type clasp comprising at least one opening and closing cover, and the two elements of the bracelet between which the fine adjustment device is intended to be inserted being formed respectively by the clasp and by an end of a strap of the bracelet, wherein the fine adjustment device comprises fixing means arranged to attach the end of the strap to the inner part, and wherein the outer part of the fine adjustment device is formed by the opening and closing cover of the clasp.

8. The fine adjustment device as claimed in claim 1, wherein when the auxiliary stop is in abutment against an edge of the outer part, the relative positions of the inner part and of the outer part are such that the first end of the lever cooperates with one of said at least one immobilization hole in order to immobilize the inner part relative to the outer part, said relative positions giving the bracelet a specific length equal to the minimum length.

9. The fine adjustment device as claimed in claim 1, wherein the inner side of the wall of the outer part has an auxiliary hole, and wherein when the stop means are in position to cooperate in order to prevent the bracelet from being lengthened further, the relative positions of the inner part and of the outer part are such that the first end of the lever cooperates with the auxiliary hole in order to immobilize the inner part relative to the outer part, said relative positions giving the bracelet the maximum length.

10. The fine adjustment device as claimed in claim 1, wherein the outer part has an inverted "U"-shaped profile, its cross-section being substantially uniform.

11. The fine adjustment device as claimed in claim 10, wherein the wall of the outer part comprises an upper face in which said at least one immobilization hole is formed, and two opposing lateral faces, the upper and lateral faces extending in planes parallel to the longitudinal direction of the bracelet.

12. The fine adjustment device as claimed in claim 11, wherein the inner part is provided with two lateral runners arranged on either side so as to be able to cooperate with two guiding grooves formed inside the two lateral faces of the wall of the outer part.

13. The fine adjustment device as claimed in claim 1, wherein the bracelet is a watch bracelet.

14. The fine adjustment device as claimed in claim 13, wherein said at least one immobilization hole and the first end of the lever are shaped such that the inner part is positioned without longitudinal play relative to the outer part.

15. The fine adjustment device as claimed in claim 1, wherein at least one immobilization hole is a blind hole.

16. The device for finely adjusting the length of a bracelet as claimed in claim 1, wherein the bracelet is a bracelet with links and wherein the dimensions of the fine adjustment device are substantially the same as the dimensions of the links of the bracelet.

17. A bracelet comprising at least one said fine adjustment device as claimed in claim 1.

18. The bracelet as claimed in claim 17, comprising two said fine adjustment devices.

* * * * *